United States Patent [19]

Klass

[11] 4,168,899

[45] Sep. 25, 1979

[54] TEMPERATURE CONTROLLED PHOTOGRAPHIC PROCESSING SYSTEM

[76] Inventor: Carl S. Klass, 25 Sunflower Dr., Hauppauge, N.Y. 11787

[21] Appl. No.: 810,098

[22] Filed: Jun. 27, 1977

[51] Int. Cl.[2] ..... G03D 3/04

[52] U.S. Cl. ..... 354/299; 354/315; 354/328; 354/344; 366/333; 134/196

[58] Field of Search ..... 354/299, 307, 310, 311, 354/312, 315, 316, 328, 331, 337, 344; 366/332, 333, 334; 134/196, 197

[56] References Cited

U.S. PATENT DOCUMENTS

| | | | |
|---|---|---|---|
| 987,821 | 3/1911 | Parkmire | 354/337 |
| 2,079,849 | 5/1937 | Geib | 366/332 |
| 2,281,094 | 4/1942 | Chambers | 366/332 |
| 2,497,429 | 2/1950 | Armstrong et al. | 354/342 |
| 2,652,758 | 9/1953 | Sardeson et al. | 366/332 |
| 3,083,427 | 4/1963 | Grenon | 354/345 |
| 3,292,520 | 12/1966 | Tucker | 354/344 |

*Primary Examiner*—L. T. Hix
*Assistant Examiner*—Alan Mathews
*Attorney, Agent, or Firm*—Robert A. Kelly

[57] ABSTRACT

Apparatus for the processing of exposed photographic negatives and prints consisting of a tank containing thermostatically controlled fluid in which are immersed one or more processing containers having the active solutions therein. A holder supporting the sensitized element with an agitator having elements facing the sensitized surface are assembled and placed within the container. The agitator has an extension which permits vibration of the agitator manually and/or electrically from outside the container which the active solution is reacting with the sensitized surface within the container.

7 Claims, 9 Drawing Figures

FIG. 3
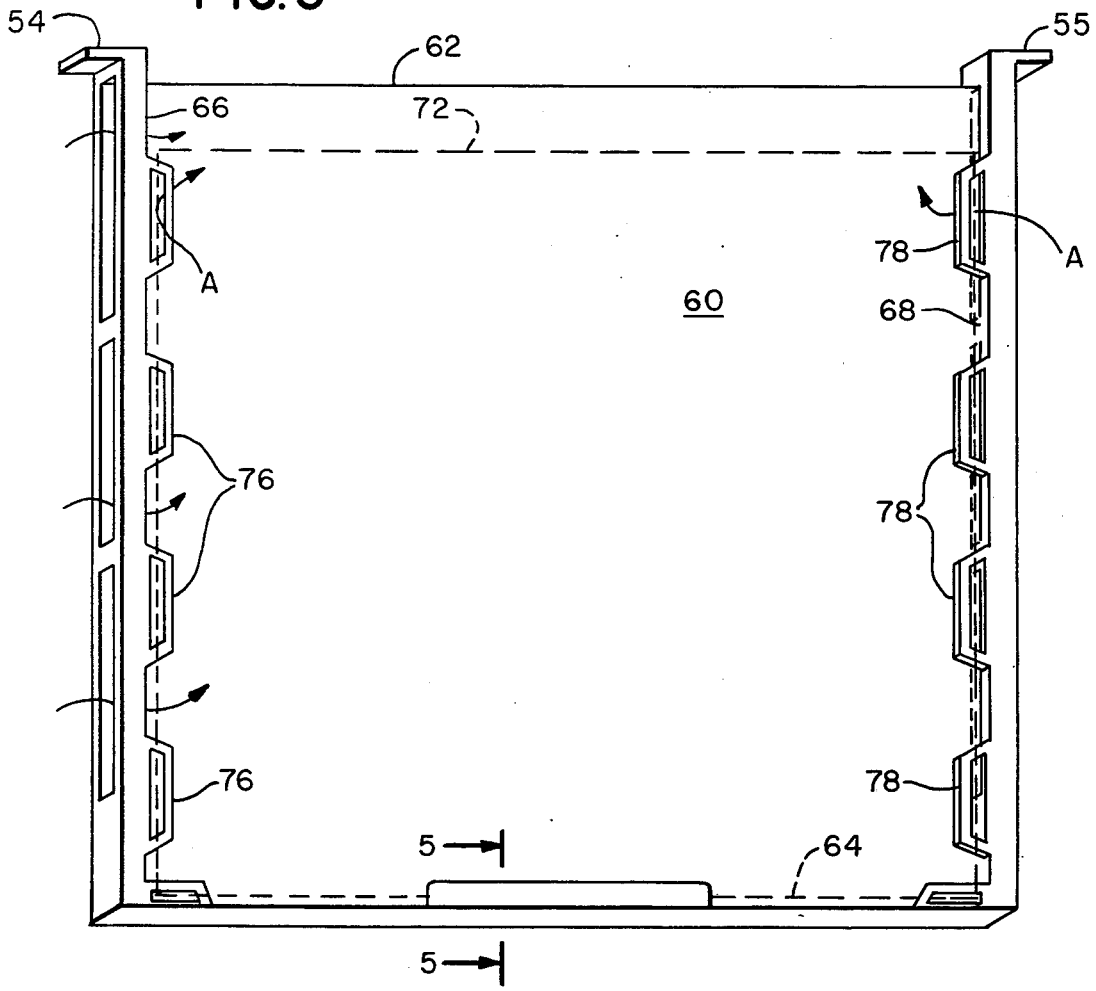
FIG. 4
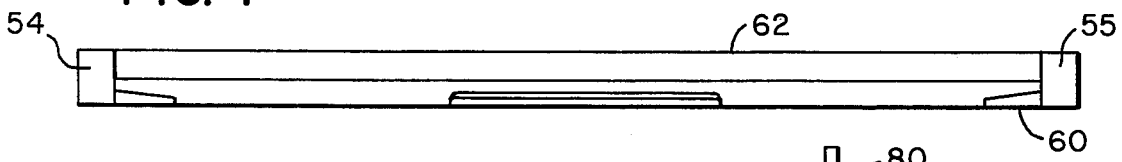
FIG. 5
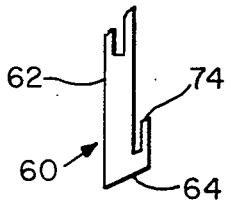
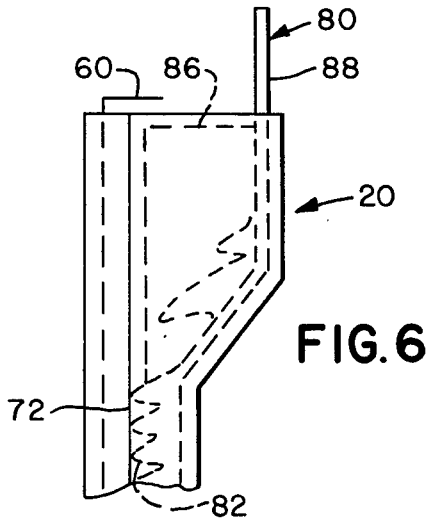
FIG. 6

112
116
122
124
110
118
114
80
88
98
102
82
96
92
94

TEMPERATURE CONTROLLED PHOTOGRAPHIC PROCESSING SYSTEM

BACKGROUND OF THE INVENTION

In the processing of photographic elements, especially color film and prints, there is a critical relationship between the temperature of the active solution and the length of time that the sensitized surface is in activated contact with the developer solution.

Thus, if the solution is maintained at a constant, predetermined temperature, there is a specific time interval during which a thorough activated contact should be maintained in order to produce optimum results. Any change in solution temperature will affect the required time of chemical contact. If the solution temperature changes or fluctuates during the period this takes place, it is usually not possible to predict in advance how the time or reaction must be altered to obtain the desired results.

Another factor which should be mentioned has to do with obtaining a uniform chemical action over the entire surface of the area being reacted. As the reaction proceeds, salts are produced which, if they remain in the immediate area, tend to inhibit locally the continuation of the reaction. By producing a uniform agitation of the solution over the whole surface of the areas being treated, it is possible to avoid non-uniform development.

The solutions customarily employed in the chemical processing of exposed photographic film and prints, especially those involved in color photography, are generally very reactive and sensitive to oxidation. When exposed to air for any significant length of time, the solution will deteriorate very rapidly due to the oxidation effect of atmospheric oxygen. In the use of such chemicals, it is therefore highly desirable to limit their exposure to air.

Heretofore, systems and apparatus employed in the development of photographic elements such as films and prints, especially color sensitive elements, have attempted to satisfy the stringent requirements described above by compromising the various factors. Thus, in one system currently in use, a drum is preheated with water to a predetermined temperature. The unit to be processed is then inserted followed by the addition of preheated solution. The print is rotated in the drum. No provision is made to maintain the temperature of the solution and while there is some solution agitation due to the rotation, there is no provision to insure the uniform and optimum velocities of the solution along the surface areas undergoing chemical treatment.

In another arrangement in use, the photographic element is placed in a tray containing solution preheated and maintained at the desired temperature. Agitation is accomplished by shaking the element and/or the tray. Due to the large solution surface exposed to the air, there is rapid deterioration of the chemical plus a tendency to produce a non-uniform distribution of temperatures throughout. Also, in such systems shear forces between the plate and the solution are too small and non uniform to be beneficial.

In a typical commercial configuration, there is provided a termostatically controlled tank of solution into which baskets containing the photographic elements are immersed. Agitation may be accomplished by shaking the baskets or providing agitators for the solution.

There are, of course, more sophisticated commercial arrangements designed to meet all of the requirements described above, but they are hardly suitable for the hobbyist or home user or others who do not have the production to justify the investment which is required.

In the arrangements described above, it is seen that it is not possible to meet, on an economic or convenience basis, all of the requirements which would insure quality and reproducible results without resorting to trial and error techniques, at best, for the hobbyist or individual worker for whom a substantial capital investment would be out of the question.

SUMMARY OF THE PRESENT INVENTION

The present invention overcomes many of the problems described above by combining in a relatively simple and economic system or apparatus a combination of features not heretofore found in equipment available to the hobbyist or individual worker. It is an apparatus for chemically processing a photographic plate or element, said element having one sensitized surface, with an active solution comprising: a tank containing a fluid; a developing container suitable for containing said active solution immersed in said tank, said container having at least a portion thereof extending above said fluid having an opening; means for controlling the temperature of said fluid in said tank; plate support means having an extended planar surface removeably insertable through said opening and immersible in the active solution in said container; attachment means for removeably mounting a photographic plate or element co-extensively along a planar surface of said plate support means; means for creating intense uniform shear forces in the solution along the entire surface of the active side of the plate mounted on said plate support means facing said means for creating shear forces between the plate and the solution; and, separator means for maintaining said plate support means and said means for creating shear forces in a spaced apart relationship to prevent said means for creating shear forces from directly contacting plate mounted on said plate support means. The holding assembly can be removed from and placed into the container without removing the latter from the inert liquid. The assembly is provided with gripping members for the photographic element which does not interfere with flow of solution along the entire active surface. Also provided is an agitation member fitted to the holding assembly having discrete elements adjacent to but not touching the active surface mounted in such a way that when the holding assembly with a photographic element is within the container, the agitation member can be shaken from outside the container to insure that there is uniform chemical activity over the complete active surface of the element.

Another preferred embodiment of the invention relates to the holding assembly as described above which is useful to process single photographic elements with minimum use of active solution under circumstances of reduced exposure to atmospheric oxygen and thorough agitation. In addition, there is provision to permit processing under ambient lighting conditions.

It is thus a principal object of this invention to provide apparatus for the processing of photographic elements utilizing relatively simple and economic construction with improved temperature control, and more effective and efficient use of the active solution.

Other objects and advantages of this invention will hereafter become obvious from the following description of preferred embodiments of this invention.

BRIEF DESCRIPTION OF THE FIGURES

FIG. 3 is an isometric view of a holder.

FIG. 4 is a top view of the holder of FIG. 3.

FIG. 5 is a view along 5—5 of FIG. 3.

FIG. 6 is a partial view of a container having a holder and agitator within ready for use.

DESCRIPTION OF THE PREFERRED EMBODIMENTS

Figure 1:
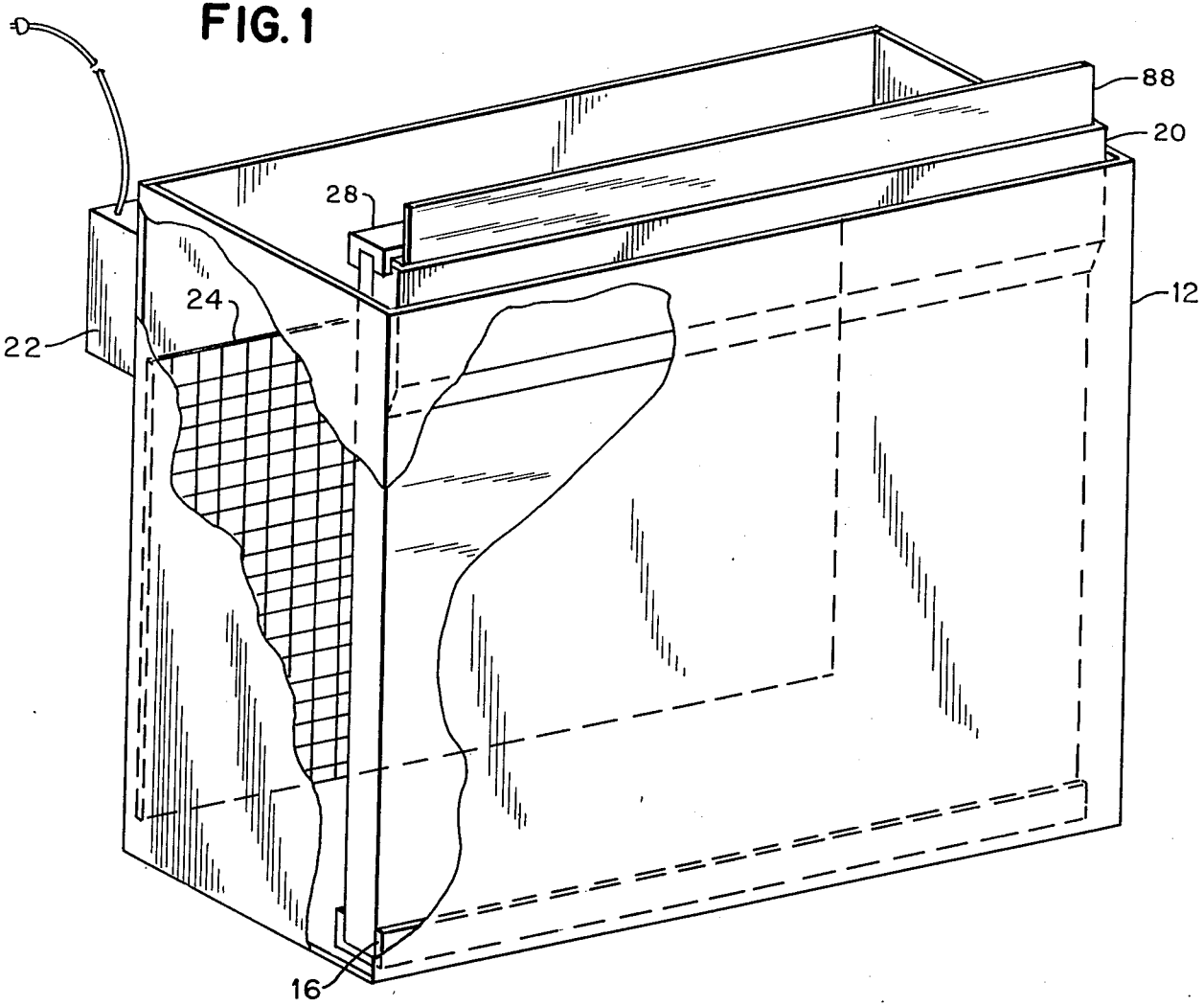
FIG. 1 is an isometric view partially cut away of the tank containing a processing container.

Referring to FIG. 1, there is shown a tank 12 which contains an inert fluid such as water when in use, one or more channels 16 each to accomodate a developing container 20, and a thermostatic heating controller 22 for a flat heating unit 24 of conventional design to maintain the temperature of the fluid within tank 12 at some predetermined value. It is understood that unit 22 could include means of circulating the liquid to insure a uniform temperature throughout. A cover (not shown) for tank 12 could also be employed if desired when developing container 20 is not being used. The walls of tank 12 could be constructed of any convenient material to limit heat loss, such as metal with insulation, or a plastic material having insulation qualities.

Figure 2:
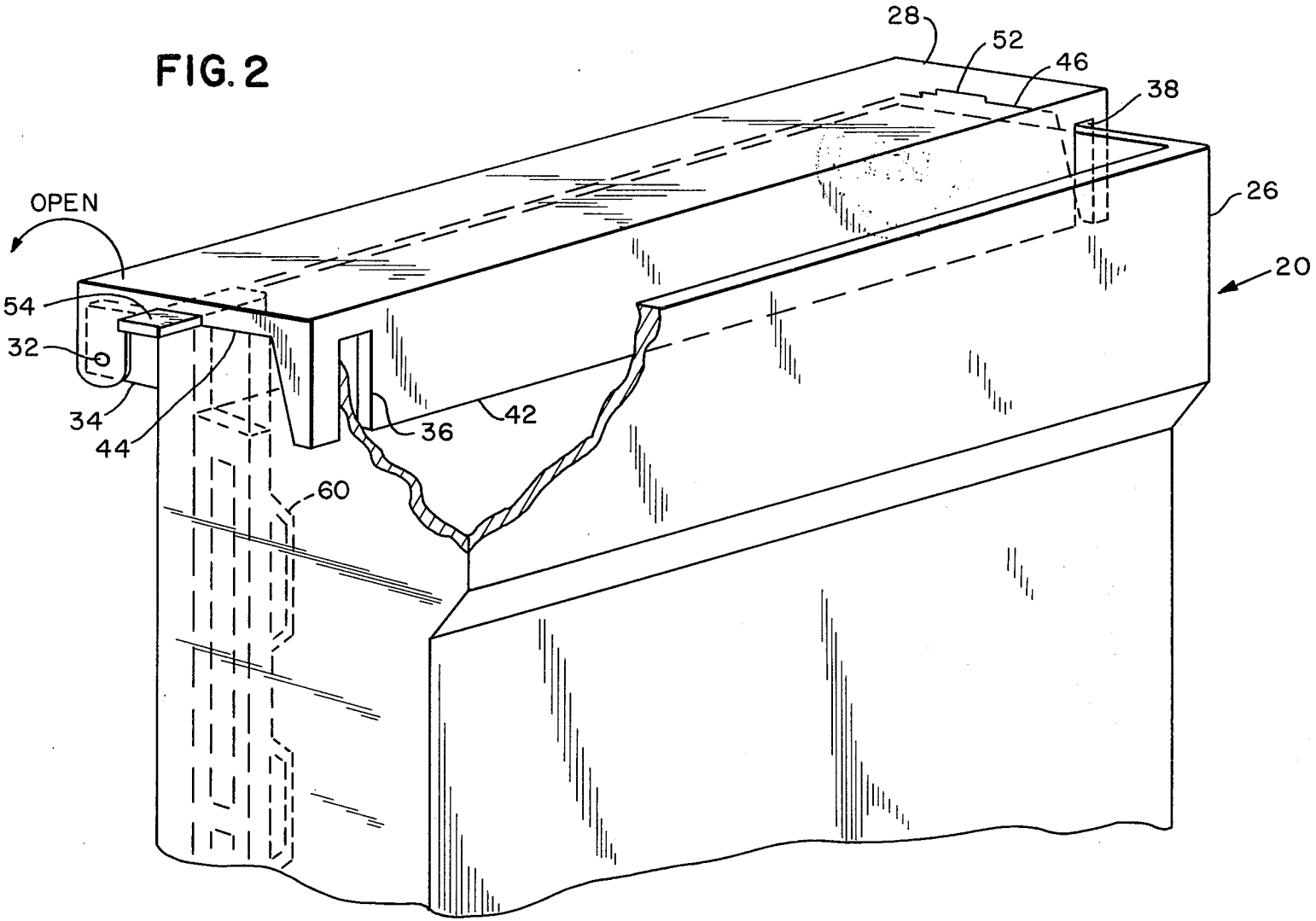
FIG. 2 is an isometric view partially cut away and partially schematic of a processing container with a holder within.

As best seen in FIG. 2, a developing container 20 is rectangular in configuration with an upper section 26 of expanded width for a purpose to be later described and open at the top thereof. Container 20 is sealed against liquid leakage so that no intermingling will take place between the liquid in tank 12 and the active solution which is within developing container 20 when in use.

To block off light into the top opening of container 20 when desired, there is provided a cover 28 hinged on a pin 32 supported by an ear 34 extending from one of the walls of container 20. There is another such ear (not shown) with a pin for hinging on the other end of container 20. It will be seen that the side of cover 28 most remote from where it is hinged does not completely cover the opening and it will be seen from the description further below there is provision to close off the exposed opening. Cover 28 is provided with slots 36 and 38 in a lip 42 to permit the former to close completely. Cover 28 is also provided with rims 44 and 46 on the sides thereof with slots 48 and 52, respectively, to accomodate a pair of finger grips (one only shown, 54) which extend out from plate support means 60 only partially shown within container 20.

Referring to FIGS. 3 and 4 for details of plate support means 60, it is seen that the latter consists of a flat rear wall 62, a bottom rim 64, and side rims 66 and 68, forming a space into which a photographic element such as an exposed print or film fits, as shown in phantom of print 72. To hold print 72 against wall 62 to minimize the creep of solution to unsensitized surface of print 72, there are provided on bottom rim 64 attachment means comprising a lip 74, as shown in FIG. 5, and retaining loops 76 and 78, respectively, on rims 66 and 68. Loops 76 and 78 are hollow, as shown to permit free circulation of the active solution, as illustrated by arrows A and to permit removeable mounting of a photographic plate coextensive along the planar surface of plate support means 60. Of course loops similar to 76 and 78 can be provided on the upper and lower edges of the plate support means when necessary to affix plates having a high degree of pliancy.

The upper end of plate support means 60 is provided with a pair of finger grips 54 and 55 (previously described) to permit the raising and lowering of the former into and out of developing container 20.

When plate support means 60 is inserted into container 20 for use, there is also provided a means for creating intense uniform shear forces in the active solution along the entire surface of the active side of a plate mounted in the plate support means 60 facing said means for creating shear forces between the plate and the solution (agitator) 80 within the latter for a purpose to be described below. As best shown in FIG. 6, it will be seen that when ready for use, container 20 contains plate support means 60 and agitator 80 snugly, although from the description below, it will be noted that there is no contact between the agitation elements 82 of agitator 80 and print 72. A light baffle 86 may be employed, if desired, and when cover 28 (not shown in FIG. 6) is down, the protruding portion 88 of agitator 80 will virtually block off all light into container 20.

Figure 8:
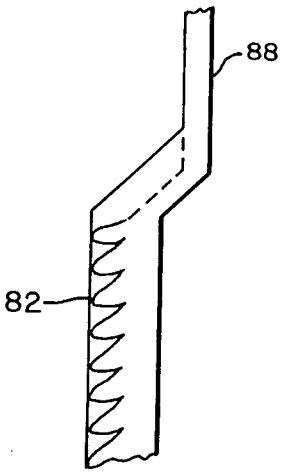
FIG. 8 is a detail of the agitator element of the agitator shown in FIG. 7.
Figures 7, 9:
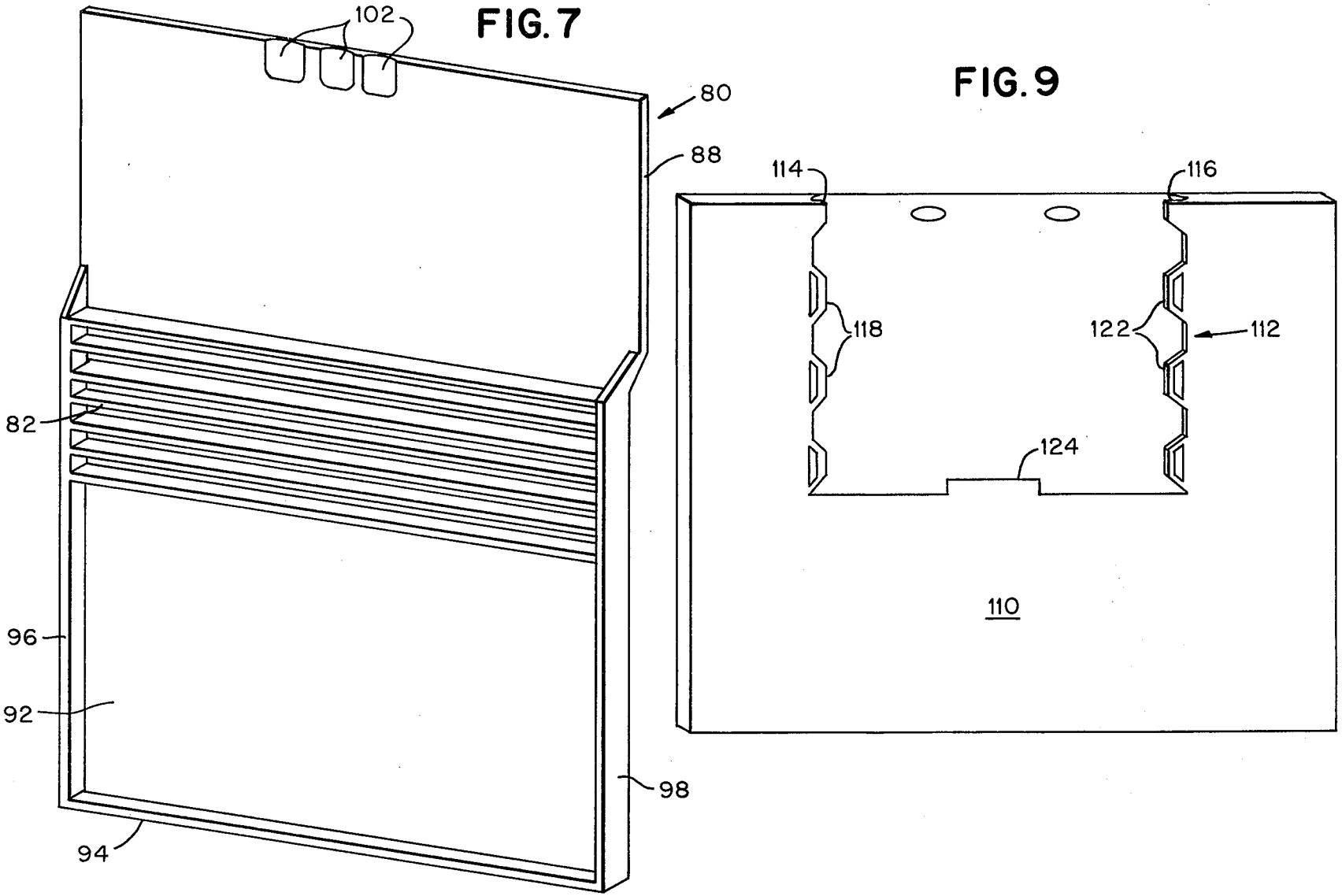
FIG. 7 is an isometric view of an agitator.
FIG. 9 is an isometric view of a sleeve for use with an undersized photographic element.

For details of means for creating intense shear forces, the agitator 80, reference is made to in FIG. 7 wherein it is seen that the former consists of a rectangular back wall 92 with a lower rim 94 and side rims 96 and 98 and a plurality of spaced vane-like agitation elements 82, previously described, spanning rims 96 and 98. Offset extension 88, previously described, of agitator 80 with finger grips 102 extend upwardly and when in use extend out of container 20. The spacing and shape of agitator elements 82 can be as shown in the detail illustrated in FIG. 8.

In the use of the apparatus described, the water within tank 12 is maintained at the temperature required for the active solutions to be used within the one or more processing containers 20. Active solution is poured into containers 20 to be used. A photographic element such as an exposed negative or print is slipped into plate support means 60 with the surface to be treated facing away from back wall 62.. Lower lip 74 and retaining elements 76 and 78 are shaped and spaced to hold the photographic element snug against back wall 62 so as to minimize creep of solution behind the element.

Agitator 80 is them placed opposite plate support means 60 with agitation elements 82 facing the photographic element. Elements 82 may be slightly recessed from rims 96 and 98 to prevent the contact with rims 96 and 98 placed up against rims 66 and 68, respectively, of holder 60. If desired, agitator 80 and plate support means may be connected or latched together for convenience of handling. Then, those two members, forming a holder assembly, are lowered into a processing container 20 which holds within the active solution at the correct temperature and which remains immersed within the liquid of tank 12. Thus there is provided alternative separator means for mounting said plate support means 60 and said means for creating shear forces in a spaced apart relationship to prevent said means from directly contacting a plate mounting on said plate support means 60.

Cover 28 may be closed and extension 88 of agitator 80 is gripped by hand and moved up and down to agitate the solution. With cover 28 closed and light baffle 86 present, ambient light may be present during the processing. It is understood, of course, that a notarized mechanical means (not shown) may be employed, if desired, to vibrate agitator 80.

After the predetermined time interval has elapsed, then holder 60 and agitator 80 are withdrawn from container 20 and the photographic element is removed for the next step in processing.

In the event it is desired to process a film or print which is smaller than can be accomodated by plate support means 60, sleeve 110 shown in FIG. 9 may be employed. The latter is a solid rectangular member the same size as plate support means 60, but having a recessed section 112 to accomodate the smaller element. Section 112 is provided with the side walls 114 and 116 with loops 118 and 122 and a bottom lip 124. Agitator 80 could be employed with sleeve 110.

In this application the term intense uniform shear forces is meant to mean that the forces resulting from the activation of the active solution upon the plate is substantially uniform over the entire surface of the plate. Thus the shear force exerted on the active solution in contact with any point on the plate is independent of the spatial coordinates of that point on the plate. Hence the dimension of the boundary layer is constant for all individual points on the plate, which results in uniform controllable reaction kinetics over the entire surface of the plate.

The distance between the plate support means and the means for creating intense uniform shear forces is critical in that for best results it is highly desireable to create laminar as opposed to turbulent flow of the active solution across the face of the plate being developed to ensure uniform development. Turbulent flow results in eddies, bubbles and swirls which in turn produces non uniform contact between the plate and the active solution.

The change from streamline to turbulent conditions in the boundary layer occurs at a certain critical distance from the leading edge. This distance depends on the shape of the leading edge and the roughness of the surface, and also on the velocity and properties of the fluid. Thus with a rough surface or a blunt edge it is comparatively short. For a given surface the transition takes place at some critical value of the Reynolds group with respect to distance x from the leading edge. This Reynolds group will be denoted by the symbol $Re_x$ and its critical value at a distance $x_c$ from the leading edge by the symbol $Re_{xc}$; $Re_{xc}$ is of the order of $10^3$.

The space between the surface of the active side of the plate mounted on the plate support means 60 and the agitator 80 is filled with active developing solution. When agitated fluid is induced to move in either laminar or turbulent flow. The two factors which determine whether this flow is laminar or turbulent for a given fluid, are the distance between the surfaces of the plate and the agitator and the velocity with which the agitator is moved. Assuming that the developing solution has the physical properties approximately equivalent to water, and given a velocity of the agitator of 1.6 feet per second, a distance of $\frac{1}{8}$ inch yields a Reynolds Number describing the fluid flow therebetween of approximately 2000, ie, at the upper threshhold of laminar flow.

It is readily seen that the apparatus as described provides in a simple and economic construction for all of the elements of good photographic processing to be met. It is readily understood by those skilled in the art that accurate photographic processing involves the accurate control of time, temperature, chemical concentration and most especially agitation. When the temperature of the solution is maintained during processing as herein provided, then it is seen that the time of processing can be predetermined. At the same time, agitation is conducted uniformly over the whole surface being processed.

It will also be noted that in the apparatus of this invention, there is very efficient use made of the active solution. By this is meant that only the exact amount of solution required is actually used because of the configuration of the parts as made and their manner of assembly and, further, there is very little solution surface exposed to air so that deterioration of the solution due to oxidation is minimized.

It is readily apparent that in addition to being highly effective and efficient in the processing of photographic elements, this invention is economic and inexpensive to produce so that it is suitable for purchase and use by individual hobbyists and workers in the field.

Now, having described the invention and the manner and process of making and using it, in full, clear, concise and exact terms so that one skilled in the art can make and use same, and having set forth the best mode contemplated by the inventor of carrying out this invention in accordance with the statute, and aware that many variations of the invention can be practiced without departing from the spirit and teachings of this specification, my invention should not be narrowly limited to the embodiment herein disclosed and illustrated, but should be construed broadly, according to the appended claims.

I claim:

1. An apparatus for chemically processing a photographic plate, said plate having one sensitized surface, with an active solution comprising:

a. a tank containing a fluid;

b. developing container means suitable for containing said active solution immersed in said tank, said container means having at least a portion thereof extending above said fluid and having an opening;

c. means for controlling the temperature of said fluid in said tank;

d. plate support means having an extended planar surface removeably insertable through said opening and immersible in the active solution in said container;

e. said plate support means including attachment means for removeably mounting a said photographic plate co-extensively along a planar surface of said plate support means;

f. agitator means for creating intense uniform shear forces in the solution along the entire surface of the active side of a said plate adjacent to and facing said plate support means for creating shear forces between the plate and the solution;

g. said agitator means having limited parallel movement with respect to said plate support means and including means for maintaining said plate support means and said agitator means in a spaced apart relationship to prevent said agitator means from directly contacting said plate mounted on said plate support means; and h. said means for creating intense uniform shear forces being composed of a reciprocatable planar shaped body capable of being held in alignment with and co-extensive with the planar surface of said plate support means, said reciprocatable planar shaped body having a plurality of vane means on the planar surface of the body facing the plate support means, said vane means being sufficient in number to create uniform intense shear forces simultaneously on the entire surface of the plate means when said planar body is reciprocated.

2. The apparatus of claim 1 which said plate support means is provided with means extending out of said developing container to permit convenient insertion and withdrawal of said plate support means.

3. The apparatus of claim 2 in which the said developing container is so shaped and constructed to maintain substantially all of said active solution in the space between said sensitized surface and the said agitator means.

4. The apparatus of claim 3 in which temperature control means is operably connected to said tank to maintain the fluid in the tank at a preselected temperature.

5. The apparatus of claim 4 in which said developing container means is provided with retractable means for blocking out light into the active solution in said container to permit processing under ambient light.

6. The apparatus of claim 5 wherein an electrical actuation means is operably connected to said means for creating said shear forces to activate said means for creating shear forces at a constant rate.

7. The apparatus of claim 3 in which said attachment means includes means for gripping said plate in a manner to prevent creep of active solution between said plate and said support means while permitting circulation of active solution in the region of said sensitized surface adjacent said gripping means.

* * * * *